US007727474B2

(12) United States Patent
Krause

(10) Patent No.: US 7,727,474 B2
(45) Date of Patent: Jun. 1, 2010

(54) CLOSURE FOR A REAGENT CONTAINER

(75) Inventor: Reinhard Krause, Reinbeck (DE)

(73) Assignee: Merck Patent Gesellschaft mit beschrankter Haftung, Darmstadt (DE)

( * ) Notice: Subject to any disclaimer, the term of this patent is extended or adjusted under 35 U.S.C. 154(b) by 988 days.

(21) Appl. No.: 10/467,330

(22) PCT Filed: Jan. 18, 2002

(86) PCT No.: PCT/EP02/00463

§ 371 (c)(1),
(2), (4) Date: Aug. 6, 2003

(87) PCT Pub. No.: WO02/062474

PCT Pub. Date: Aug. 15, 2002

(65) Prior Publication Data

US 2004/0067169 A1 Apr. 8, 2004

(30) Foreign Application Priority Data

Feb. 8, 2001 (DE) ..... 101 05 753

(51) Int. Cl.
*B01L 3/02* (2006.01)

(52) U.S. Cl. ..... 422/100; 422/102; 436/180

(58) Field of Classification Search ..... 422/100, 422/101, 102; 436/49, 54, 174, 178, 180
See application file for complete search history.

(56) References Cited

U.S. PATENT DOCUMENTS 4,515,752 A 5/1985 Miramanda
4,600,112 A * 7/1986 Shillington et al. ..... 215/274
4,954,149 A 9/1990 Fullemann
5,081,872 A * 1/1992 Greter ..... 73/864.74
5,169,602 A * 12/1992 Pang et al. ..... 422/103
5,297,599 A 3/1994 Bucheli
6,030,582 A * 2/2000 Levy ..... 422/99
6,032,812 A * 3/2000 Lamoureux ..... 215/303
6,716,396 B1 * 4/2004 Anderson et al. ..... 422/99

* cited by examiner

*Primary Examiner*—Jill Warden
*Assistant Examiner*—Dwayne K Handy
(74) *Attorney, Agent, or Firm*—Millen, White, Zelano & Branigan, P.C.

(57) ABSTRACT

The invention relates to a closure for a reagent container (7) with a screw-cap or lid (6), comprising a conical insert (4), reaching in the direction of the contents. The conical insert (4) is cut at least once, such that said insert may be bent apart in the lower region thereof and further comprises, for example, an annular step (3) in the middle region thereof. In the rest state the cone completely seals the reagent container. For the removal of liquid, a pipette with a release sleeve (2), in other words, a broadening (2) at a particular separation from the needle end (1), is introduced. The release sleeve contacts the step of the conical insert (3) and produces a separation of the divided walls of the cone. The pipette needle enters the container without making contact with the cone, in other words with the closure. As the pipette needle, complete with release sleeve (2), is withdrawn, the walls of the cone close back together, as the release sleeve (2) is no longer pressing on the step (3).

7 Claims, 2 Drawing Sheets

CLOSURE FOR A REAGENT CONTAINER

The invention relates to a closure for reagent containers and to a method for the withdrawal of reagents using pipettes or pipetting needles.

Liquid chemicals and diverse samples, such as serum, plasma, liquor, etc., are stored in glass or plastic containers in medical, chemical or biological laboratories. Withdrawal is carried out manually by means of, for example, a pipette or syringe or automatically, for example through the pipetting needle of an automatic pipetting device.

It is generally necessary to keep the reagent containers closed during storage in order that the contents are not lost through evaporation, exposed to moisture or aged in another way through contact with air. The reagent containers must therefore be opened before withdrawal of a sample. After the withdrawal, the container must be re-sealed.

A very wide variety of closures are known for reagent containers:

Screw Closures:

Screw closures have to be manually or mechanically unscrewed before reagent withdrawal and subsequently screwed on again. This is complex and can only be carried out with difficulty by automatic pipetting devices. In addition, the use of screw caps can easily result in confusion in the case of a high throughput of containers since the caps have to be placed on one side during withdrawal. It can thus occur that an incorrect cap is screwed on during sealing. This can in turn result in mistaken contents of the containers or in contamination.

Stopper Closures:

In stopper closures, the same disadvantages arise as in screw closures. In addition, stopper closures can release themselves, for example in the case of an excess pressure in the vessel.

Membrane Closures:

These closures have a membrane of plastic or, for example, latex compounds which is pierced with a pipette or needle for sample withdrawal. In EP 0 504 697, a flat membrane was replaced by an indentation extending conically inwards which can be pierced at the tip for liquid withdrawal. The disadvantage of these types of closure is that the nature of the membrane often does not meet all the demands made of it. On the one hand, it may be too stable to be pierced. On the other hand, the membrane may no longer seal the container completely after piercing. In addition, on each piercing a small amount of substance from the outside of the pipette remains attached to the membrane, where it may dry or change due to exposure to air/moisture and re-enters the container, for example during the next withdrawal, where it then contaminates the contents. Furthermore, especially in the case of certain chemicals, partial dissolution of the membrane can occur or particles of the membrane can enter the container.

Cross-Cut Closures:

These closures are similar to membrane closures. A membrane, film or stopper is cut crosswise so that a pipette or needle can be inserted into the intersection of the cuts. An example is given in WO 90/09330. The disadvantage of this method is that, in particular on repeated use, a tight seal of the container is no longer guaranteed. In addition, chemical residues may again be deposited on the membrane during insertion and withdrawal of the pipette.

Automatic Closures:

Automatic pipetting devices have various integrated, usually complicated devices which, through mechanically or electrically actuated slides, discs, etc., open an aperture through which pipetting can be carried out. An example thereof is given in U.S. Pat. No. 5,542,575. Owing to the considerable mechanical complexity and the cost, devices of this type are only used for few reagent containers in automatic pipetting devices. They are not suitable for manual withdrawal.

It should also be noted in closures for automatic pipetting devices that incorrect liquid detection (for example in the case of liquid detection by induction) can be caused if the pipetting needle slides along a conductive surface, such as, for example, the moist surface of a membrane, during withdrawal before immersion into the sample. This can result, for example, in the pipetting of air bubbles.

The object of the present invention was therefore to find a closure for reagent containers which is suitable for both manual and automatic sample withdrawal, which seals the container tightly during storage and which prevents contamination of the contents of the container during withdrawal.

It has been found that these requirements are satisfied by a closure which has a screw cap or lid with a conical insert aligned in the direction of the contents. The conical insert is cut at least once so that it can be bent apart in the lower region, and additionally has a, for example, annular ridge in the central region. In the rest state, the cone completely seals the reagent container. For liquid withdrawal, a pipette with an actuation sleeve, i.e. a thickening at a certain separation from the end of the needle, is inserted. The actuation sleeve comes into contact with the ridge of the conical insert, causing the divided walls of the cone to bend apart. The pipetting needle enters the container without touching the cone, i.e. the closure. If the pipetting needle is withdrawn together with the actuation sleeve, the walls of the cone close again since the actuation sleeve no longer forces the ridge apart. The vessel is tightly sealed again.

The present invention therefore relates to a closure C for a reagent container consisting of a cap part (6) for attachment to the reagent container (7) and a conical insert (4), where the conical insert (4) is incorporated into an opening of the cap part and has a conical or pyramidal wall which terminates in a point in the direction of the reagent container, characterized in that the conical or pyramidal wall is divided into flaps by at least one cut going through the tip and has a actuation ridge (3) on the side facing away from the reagent container.

In a preferred embodiment, the conical insert is provided on the side facing the reagent container with pressure springs, elastic bands or an elastic membrane.

The present invention also relates to a method for the withdrawal of liquids from reagent containers which are provided with a closure according to the invention, characterised by the following method steps:

a) provision of a reagent container sealed in accordance with the invention and a pipette (i.e. pipette, syringe or automatic pipetting device) whose pipetting needle (1) is provided with an actuation sleeve (2);

b) vertical insertion of the pipetting needle (1) into the centre of the conical insert (4) of the closure according to the invention until the end of the pipetting needle (5) dips into the liquid, with the flaps on the actuation ridge (3) of the conical insert (4) being pushed outward by the actuation sleeve (2) so that the pipetting needle (1) does not touch the conical insert (4);

c) drawing-off or injection of liquid;

d) vertical withdrawal of the pipette, during which the flaps of the conical insert (4) close tightly again as soon as the actuation sleeve (2) no longer pushes the flaps outward.

The present invention also relates to a pipetting device consisting of at least one reagent container which is provided with a closure according to the invention and at least one pipette which has a pipetting needle with an actuation sleeve.

The closure according to the invention is suitable for all types of reagent container which are on the one hand to be sealed as tightly as possible during storage and on the other hand are not to be opened in an additional working step for withdrawal, in particular for repeated withdrawal. In particular, these are reagent containers for chemical, biological or medical applications. The closure is suitable for manual withdrawal and particularly preferably for use in automatic pipetting devices.

The closure according to the invention comprises a cap part which enables fixing to the reagent container. This can be a screw cap or plug cap or, for example, also a sealing ring which is attached by means of a metal clasp. It is preferably a screw cap.

A conically shaped insert is incorporated into the cap part of the closure, typically in the centre. Accordingly, an opening, typically annular, into which the conical insert is incorporated, is located in the centre of the cap part. The cap part and conical insert can be made of one or more parts and materials. In the case of the use of a metal clasp for attachment of the closure to the reagent container, the remainder of the closure can be made of one part consisting of sealing ring and conical insert.

The conical insert has a conical wall or a pyramidal wall (i.e. a wall having at least three surfaces which run together in the downward direction), where the tip of the cone or pyramid faces downward, i.e. in the direction of the contents of the reagent container. The height and base area of the conical insert are dependent on the diameter and height of the reagent container to be sealed. In order that the container is able to accommodate a sufficiently large amount of liquid, the insert should typically not project into the container further than at most half the height of the latter.

Figure 1:
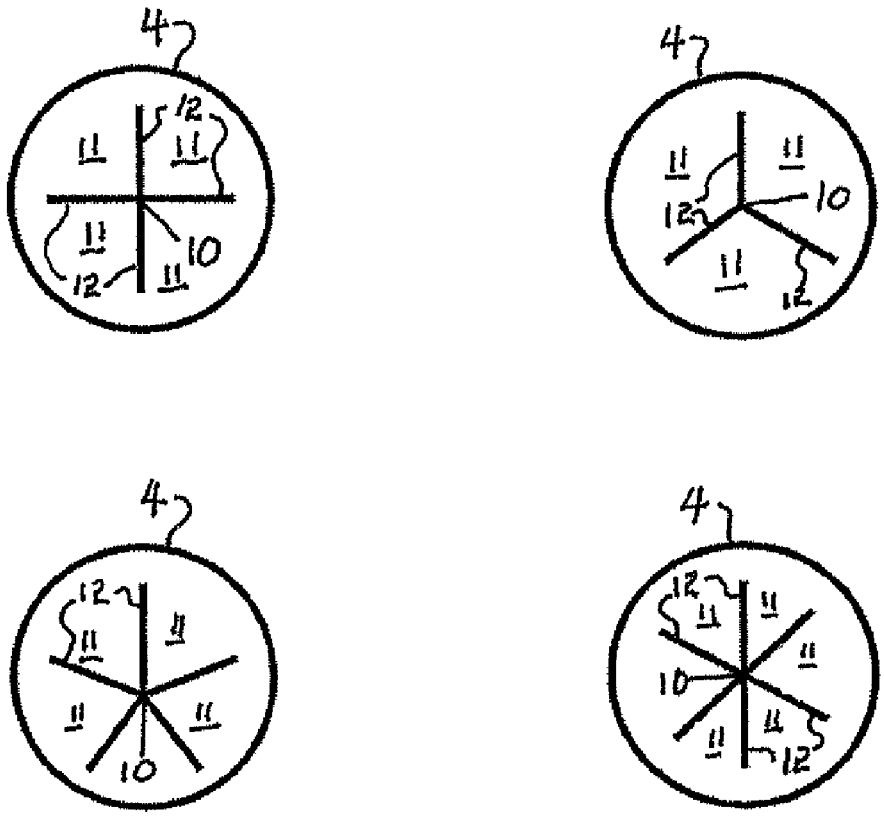
FIG. 1 shows a diagrammatic representation of possible cuts of the conical insert.

The conical insert has at least one cut, preferably 2 to 5 cuts. A representation of the possible arrangements of the cuts is shown in FIG. 1. The conical insert here is depicted diagrammatically as a plan view onto the tip of a cone. The cuts are of such a nature that the wall of the insert is completely cut through, preferably symmetrically, from the point of view of the tip of the cone or pyramid. Accordingly, a number of flaps are produced which form the lower part of the cone or pyramid as far as the tip. The cuts typically do not extend as far as the upper edge of the cone or pyramid.

In addition, the conical insert has actuation webs in the interior, i.e. on the side facing away from the contents of the container to be sealed. These actuation webs are typically located approximately at half the height of the cone or pyramid. The actuation webs are formed by a protuberance of the wall or by a bead attached to the wall. This can be a ring or, for example, a plurality of discontinuous individual webs located at the height of the cone or pyramid wall. In the case of a plurality of webs, at least one ridge must be located on each flap of the wall formed by the cuts. The cuts of the conical insert always extend beyond the actuation ridge, so that the cone or pyramid is already divided into a plurality of flaps at the height of the actuation ridge.

The features of the preceding two paragraphs are made possible by the structure shown in FIGS. 2A and B wherein the pipette 1 has an actuator (2) thereon which is axially spaced from an insertion end (5) of the pipette (1) and wherein the conical or pyramidal wall of a conical insert (4) is divided into flaps (11) by at least one cut (12). The wall has an actuation ridge (3) on a side facing away from a reagent container (7). The actuator ridge (3) has a diameter defining an opening larger than the diameter of the pipette (1) and smaller than the diameter of the actuator (2) on the pipette (1), wherein the pipette (1) need not engage the conical insert (4) to enter the reagent container (7) because the actuator (2) engages flaps (10) to deflect the flaps away from the pipette (1). The flaps (10) close upon withdrawal of the actuator (2) from the actuation ridge (3) after the pipette (1) leaves the entrance point (10) of the conical insert (4). Preferably, the actuator (2) is in the form of an actuator sleeve (2).

The conical insert is typically incorporated or inserted into the centre of the cap part and extends vertically downward into the interior of the vessel to be sealed. In certain cases, however, it is also possible for the cap part to be shaped in such a way that it forms an extension of the vessel neck in an upward direction and the conical insert of the closure according to the invention is located inside the cap part and only projects slightly or not at all into the interior of the vessel. It is equally possible for the closure according to the invention to be designed for vessels which are placed at an incline, for example in the holder of an automatic pipetting device. The conical insert is then preferably integrated into the cap part at an angle or the entire closure according to the invention is aligned at an angle so that vertical pipetting is possible in spite of the inclined arrangement of the vessel.

The closure according to the invention can consist of plastic, metal, glass, ceramic or composite materials predominantly composed of the said materials. It preferably consists of plastic. The cap part and conical insert can consist of the same or different materials. Furthermore, the cap part and conical insert themselves can also consist of one or more materials. In particular, the conical insert can be provided, for example on the side facing the interior of the vessel, with a chemically inert coating, for example Teflon.

For correct withdrawal of liquid from a reagent container which is sealed with a closure according to the invention, a pipette or syringe is typically used. The tip or needle thereof, generally referred to below as pipetting needle, is to this end provided with an actuation sleeve. The actuation sleeve is a typically rod-shaped moulding which has a bore along the longitudinal axis into which the pipetting needle can be inserted. The ends of the moulding are preferably flattened or bevelled off at an angle. The cross section of the rod-shaped moulding can represent, for example, a circle, an oval, a square or a triangle. The size of the diameter of the moulding can furthermore change along the longitudinal axis of the rod, so that it has, for example, the greatest diameter in the centre of the longitudinal axis and becomes thinner towards the ends. The actuation sleeve is particularly preferably a cylindrical moulding having a circular cross section which reduces in size towards the ends. The shape and size of the actuation sleeve have to be matched to the size of the closure according to the invention and in particular the shape of the conical insert and the actuation ridge.

The actuation sleeve is pushed onto the pipetting needle at a certain separation from the end of the needle. The separation from the end of the needle and the dimensions (diameter and length) of the actuation sleeve are determined by the size and dimensions of the closure according to the invention. The actuation sleeve must be of such a nature and positioned in such a way that, on insertion of the pipetting needle, the actuation sleeve comes into contact with the actuation ridge of the conical insert before the pipetting needle itself can touch the closure. The pressure of the actuation sleeve pushes the actuation webs outward and bends the flaps of the conical insert apart. This causes the formation of an opening at the tip, through which the end of the needle can be dipped into the reagent solution on further insertion of the pipette. After the pipetting operation, the pipetting needle is pulled out of the vessel again, during which the end of the needle does not touch the closure according to the invention since the actuation sleeve keeps the flaps of the conical insert apart until the pipetting needle leaves the interior of the reagent container. The flaps subsequently close together again, and the conical insert seals the container tightly.

The actuation sleeve must be sufficiently long that it pushes the actuation webs apart during immersion of the pipetting needle into the reagent, so that the pipetting needle does not touch the closure, more precisely the conical insert of the closure.

The actuation sleeve can consist, for example, of plastic, metal, ceramic or glass. It must not slide along the pipetting needle during the pipetting operation, in particular during contact with the actuation ridge. The actuation sleeve is therefore preferably pinned, fixed with holders or particularly preferably bonded to or incorporated directly into the needle.

The separation of the actuation sleeve from the end of the pipetting needle is determined by the depth of the conical insert and the position of the actuation ridge. The actuation sleeve must ensure that the flaps of the conical insert open during insertion of the pipette before the end of the pipetting needle reaches the tip of the cone. During this operation, it must be ensured that the pipette is not immersed so far into the sample solution that the actuation sleeve also comes into contact with the liquid. In the case of automatic pipetting devices, this is generally not a problem since the time at which immersion into the liquid takes place is determined by means of induction measurement and the needle is then no longer inserted significantly more deeply.

The pipetting needle thus at no point during sample withdrawal touches the closure of the reagent container on use of a closure according to the invention in combination with a pipetting needle with actuation sleeve. Reagent deposits cannot form on the closure, preventing possible contamination of the vessel contents, for example due to dried reagent residues falling back.

In order that the reagent container is tightly sealed during storage, the individual flaps of the conical insert must close tightly again after sample withdrawal has taken place. This can be supported, for example, by the conical insert being provided on the side facing the interior of the vessel with pressure springs, elastic bands or a stocking-like, elastic membrane which has an opening at the tip. Overall, the conical insert should be made of a material that is not too brittle to close tightly again after the flaps have been opened. The material should furthermore be sufficiently stable for the flaps to be opened sufficiently widely, in particular in the region of the tip, during insertion of the pipette. If desired, this can be implemented through the use of a plurality of material layers, for example an elastic and tight-sealing layer for the vessel interior and a more stable, harder outer layer. In the same way, the walls of the conical insert can have other seals, braces or reinforcements.

Figure 2:
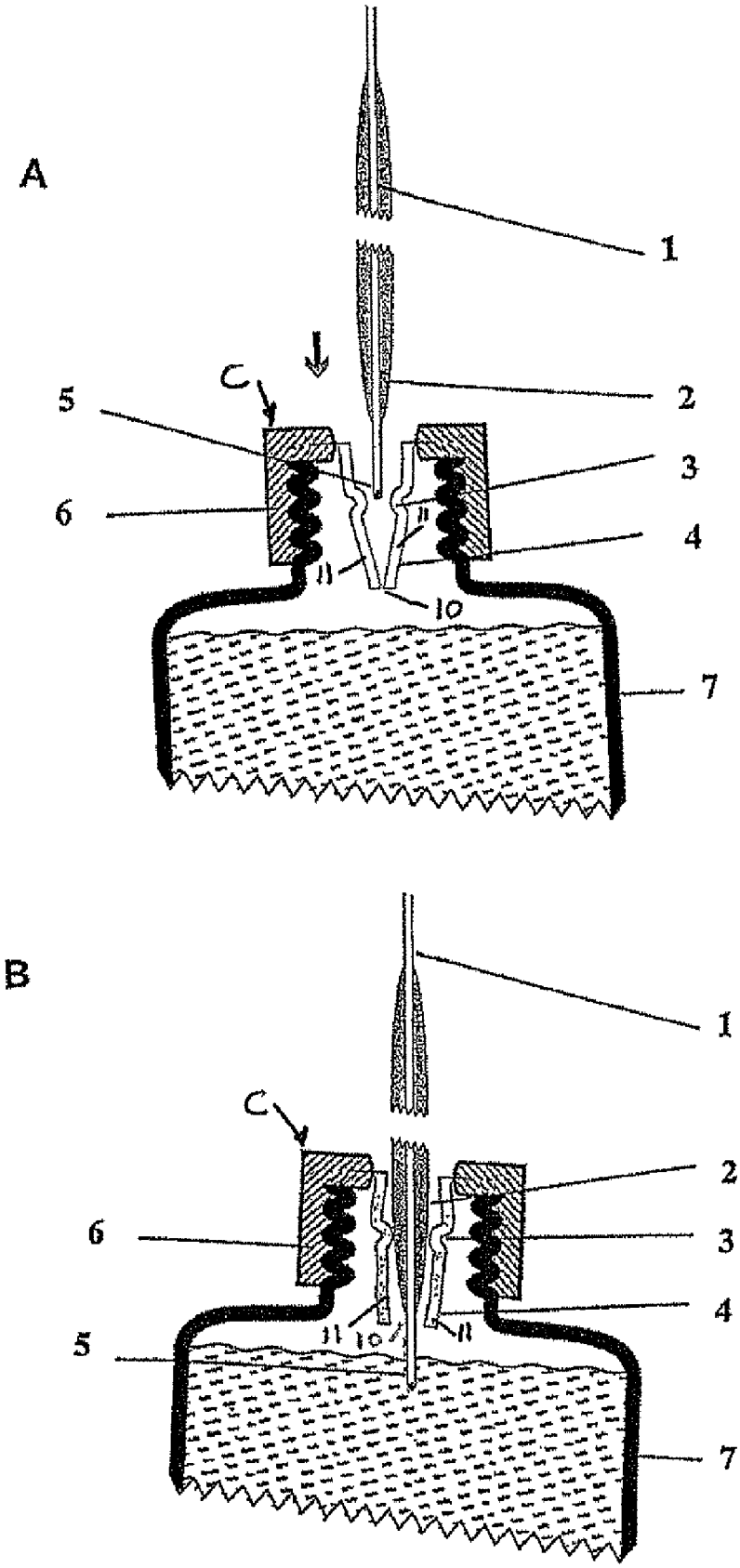
FIG. 2 shows a diagrammatic representation of a closure according to the invention in closed (A) and opened (B) form.

FIG. 2 shows a reagent container sealed in accordance with the invention in the closed state (A) and opened during the pipetting operation (B).

(A): The reagent container (7) is tightly sealed by means of the closure according to the invention consisting of cap part (6) and conical insert (4) with actuation ridge (3). On vertical insertion of the pipette (1) with actuation sleeve (2), the end of the pipetting needle (5) does not touch the closure.

(B): the actuation sleeve (2) pushes the flaps of the conical insert (4) on the actuation ridge (3) outward, and the end of the pipetting needle (5) can be dipped into the reagent container (7). The actuation sleeve (2) must not touch the liquid surface. In the opened state, gas exchange with the environment is possible, meaning that a reduced pressure is not formed during liquid withdrawal.

A pipetting device for carrying out the pipetting method according to the invention accordingly comprises at least one pipette (i.e. pipette, syringe or automatic pipetting device) whose pipetting needle has an actuation sleeve, and a reagent container which is sealed by means of the closure according to the invention.

The pipetting method comprises the following steps:

- provision of a reagent container sealed in accordance with the invention and a pipette whose pipetting needle is provided with an actuation sleeve
- vertical insertion of the pipetting needle into the centre of the conical insert of the closure according to the invention until the end of the pipetting needle dips into the liquid. During this operation, the flaps at the actuation ridge of the conical insert are pushed outward by the actuation sleeve so that the pipetting needle does not touch the conical insert.
- drawing-off or injection of liquid
- vertical withdrawal of the pipette, during which the flaps of the conical insert close tightly again as soon as the actuation sleeve no longer pushes the flaps outward.

The closure according to the invention or the method according to the invention thus offers the following advantages:

- tight sealing of the reagent container, preventing, for example, moisture exchange with the environment;
- the withdrawal of the liquid can take place without a screw closure, stopper or the like having to be removed in an additional working step;
- the risk of contamination due to mixed-up closures is avoided;
- the risk of contamination due to contact of the pipetting needle with the closure is avoided;
- the closure seals tightly even after a number of withdrawals;
- common automatic pipetting devices can work with the closure according to the invention without complex refitting since adaptation requires only the use of a pipetting needle provided with actuation sleeve;
- on withdrawal of the liquid from the reagent container, a reduced pressure is not formed on use of the closure according to the invention since during the withdrawal the vessel is not completely tightly sealed by the pushing-apart of the flaps of the conical insert;
- in automatic pipetting devices, pipetting errors are prevented since the pipetting needle does not touch the closure, which can give the impression of the liquid surface in an induction measurement, before contact with the sample.

Even without further comments, it is assumed that a person skilled in the art will be able to utilise the above description in its broadest scope. The preferred embodiments and examples should therefore merely be regarded as descriptive disclosure which is absolutely not to be regarded as limiting in any way.

The complete disclosure content of all applications, patents and publications mentioned above and below, in particular the corresponding application DE 101 05 753.9, filed on Aug. 2, 2001, is incorporated into this application by way of reference.

The invention claimed is:

1. A pipetting arrangement comprised of a pipette, a closure and a container, the pipetting arrangement providing for withdrawal of liquids from a reagent container (7), wherein the pipetting arrangement comprises a pipette (1) having an actuator sleeve (2) positioned around and permanently attached to the pipette (1), the actuator sleeve (2) being axially spaced from an insertion end (5) of the pipette (1) and wherein a closure for the reagent container (7) is accessible by said pipette (1) and has an insertion end (5) consisting of a cap part (6) for attachment to the reagent container (7) and a conical insert (4), wherein the conical insert (4) is incorporated into an opening of the cap part (6) and has a conical or pyramidal wall which terminates in a entrance point (10) in the direction of the reagent container (7) in that the conical or pyramidal wall of the conical insert (4) is divided into flaps (11) by at least one cut (12) and has an actuation ridge (3) on a side facing away from the reagent container (7), the actuation ridge (3) having a diameter defining an opening larger than the diameter of the pipette (1) and smaller than the diameter of the actuator (2) on the pipette (1), wherein the pipette (1) need not engage the conical insert (4) to enter the reagent container (7) because the actuator (2) engages the flaps (11) to deflect the flaps away from the pipette (1), and wherein the flaps (11) close upon withdrawal of the actuator (2) from the ridge (3) after the pipette (1) leaves the entrance point (10) of the conical insert (4), wherein when the pipette (1) is withdrawn together with the actuation sleeve (2), walls of the conical insert (4) reclose since the actuating sleeve (2) no longer forces the actuation ridge (3) apart again tightly sealing the reaction container (7), which prevents contamination of contents in the reaction container (7) during withdrawal of the pipette (1).

2. A pipetting arrangement according to claim 1 wherein there is at least one pipette is configured as a pipetting needle (1).

3. The pipetting arrangement according to claim 1 wherein the conical insert (4) is provided on the side facing the reagent container (7) with pressure springs, elastic bands or an elastic membrane.

4. A pipetting arrangement according to claim 3 wherein there is at least one pipette configured as a pipetting needle (1), the pipetting arrangement being in combination with at least one reagent container (7).

5. A method for the withdrawal of liquids from or dispensing liquids into a reagent container utilizing the pipetting arrangement of claim 1, comprising:

a) providing the reagent container (7) sealed with the closure (C) and using the pipette (1);

b) inserting vertically the pipette (1) into the center of the conical insert (4) of the closure (C) until the insertion end (5) of the pipette (1) dips into liquid within the reagent container, with the flaps on the actuation ridge (30) of the conical insert (4) being pushed outward by the actuator (2) by engagement with an actuation ridge (3) so that the pipette (1) does not touch the conical insert (4);

c) drawing-off the liquid in the reagent container by drawing the liquid through the pipette (1) or dispensing a liquid from the pipette into the reagent container (7), and d) vertically withdrawing the pipette (1), during which the flaps (11) of the conical insert (4) close tightly as soon as the actuator (2) no longer pushes the flaps (11) outward.

6. A pipetting method according to claim 5 wherein there is at least one pipette configured as a pipetting needle (1), the pipetting arrangement being in combination with at least one reagent container (7).

7. A method for the withdrawal of liquids from or dispensing liquids into a reagent container utilizing the pipetting arrangement of claim 3, comprising:

a) providing the reagent container (7) sealed with the closure (C) and using the pipette (1);

b) inserting vertically the pipette (1) into the center of the conical insert (4) of the closure (C) until the insertion end (5) of the pipette (1) dips into liquid within the reagent container, with the flaps (11) on the actuation ridge (3) of the conical insert (4) being pushed outward by the actuator (2) so that the pipette (1) does not touch the conical insert (4);

c) drawing-off the liquid in the reagent container by drawing the liquid through the pipette (1) or dispensing a liquid from the pipette (1) into the reagent container (7), and d) vertically withdrawing the pipette (1), during which the flaps (11) of the conical insert (4) close tightly as soon as the actuator (2) no longer pushes the flaps (11) outward.

* * * * *

UNITED STATES PATENT AND TRADEMARK OFFICE

CERTIFICATE OF CORRECTION

PATENT NO. : 7,727,474 B2
APPLICATION NO. : 10/467330
DATED : June 1, 2010
INVENTOR(S) : Krause It is certified that error appears in the above-identified patent and that said Letters Patent is hereby corrected as shown below:

Column 7, line 43 reads "there is at least one pipette is configured as a pipetting needle" should read -- there is at least one pipette configured as a pipetting needle --

Signed and Sealed this

Seventh Day of September, 2010

David J. Kappos

David J. Kappos
*Director of the United States Patent and Trademark Office*